US007325586B2

(12) United States Patent
Deibl et al.

(10) Patent No.: US 7,325,586 B2
(45) Date of Patent: Feb. 5, 2008

(54) INTERNALLY COOLED BILLET GUIDING ROLLER

(75) Inventors: Günther Deibl, Leonding (AT); Josef Guttenbrunner, Sierning (AT); Josef Lanschuetzer, Mauthausen (AT); Johann Poeppl, Kirchschlag (AT); Guoxin Shan, Linz (AT); Heinrich Thoene, Linz (AT); Franz Wimmer, Riedau (AT)

(73) Assignee: Voest-Alpine Industrieanlagenbau GmbH & Co. (AT)

( * ) Notice: Subject to any disclaimer, the term of this patent is extended or adjusted under 35 U.S.C. 154(b) by 0 days.

(21) Appl. No.: 10/564,380

(22) PCT Filed: Jul. 7, 2004

(86) PCT No.: PCT/EP2004/007399

§ 371 (c)(1),
(2), (4) Date: Mar. 21, 2006

(87) PCT Pub. No.: WO2005/016578

PCT Pub. Date: Feb. 24, 2005

(65) Prior Publication Data

US 2006/0191662 A1 Aug. 31, 2006

(30) Foreign Application Priority Data

Jul. 18, 2003 (AT) ..... A 1132/2003

(51) Int. Cl.
*B22D 11/124* (2006.01)

(52) U.S. Cl. ..... 164/442; 164/448

(58) Field of Classification Search ..... 164/448, 164/442, 427

See application file for complete search history.

(56) References Cited

U.S. PATENT DOCUMENTS

| | | | | |
|---|---|---|---|---|
| 4,442,883 | A | 4/1984 | Yamakami et al. | 164/448 |
| 4,506,727 | A | 3/1985 | Swasey | 165/90 |
| 4,593,744 | A | 6/1986 | Lewin et al. | 164/448 |
| 5,279,535 | A | 1/1994 | Hawes et al. | 492/46 |
| 2004/0025312 | A1 | 2/2004 | Flemming et al. | 29/46 |

FOREIGN PATENT DOCUMENTS

| | | |
|---|---|---|
| DE | 25 52 969 | 6/1977 |
| WO | WO 93/19874 | 10/1993 |
| WO | WO 02/38972 | 5/2002 |

OTHER PUBLICATIONS

International Search Report PCT/EP2004/007399 dated Dec. 7, 2004.

*Primary Examiner*—Kevin P. Kerns
(74) *Attorney, Agent, or Firm*—Ostrolenk, Faber, Gerb & Soffen, LLP

(57) ABSTRACT

An internally cooled strand-guiding roll for a continuous casting installation, having a central rotatable shaft and at least one roll shell supported fixed against rotation on the shaft. To make the strand-guiding roll better able to withstand the mechanical and thermal stresses, to ensure that it is suitable for large strand widths and to enable maintenance work to be carried out, the roll shell has coolant passages passing through it, and the coolant passages are arranged in the roll shell at a constant distance from the cylindrical roll shell outer surface of the roll shell and preferably at the area between the shaft and the roll shell. It is preferable for at least one water guide ring to be arranged between the roll shell and the central shaft.

16 Claims, 4 Drawing Sheets

INTERNALLY COOLED BILLET GUIDING ROLLER

CROSS REFERENCE TO RELATED APPLICATIONS

The present application is a 35 U.S.C. §§ 371 national phase conversion of PCT/EP2004/007399, filed Jul. 7, 2004, which claims priority of Austrian Application No. A 1132/2003, filed Jul. 18, 2003. The PCT International Application was published in the German language.

BACKGROUND OF THE INVENTION

The invention relates to an internally cooled strand-guiding roll, preferably for a continuous casting installation, having a central rotatable shaft and at least one roll shell which is supported fixed against rotation on this shaft.

Strand-guiding rolls are used in continuous casting installations to support and guide continuously cast metal strands after they have emerged from a permanent mold in a strand-guiding stand. They are exposed to high thermal stresses, since the cast metal strands leave the mold at a temperature of over 1000° C., in particular in the case of steel strands. When producing relatively thick strands, especially in slab formats, a considerable liquid core is also still present in the strand, as a result of which ferrostatic forces act on the strand-guiding rolls. In addition, the strand-guiding rolls have to be able to withstand deformation forces from the strand bending. Accordingly, the strand-guiding rolls are usually equipped with internal cooling and have a robust design which matches the mechanical stresses. Large strand widths of the cast strands of up to 3 m require multiple mounting of the strand-guiding roll, and accordingly a multi-part structure of the supporting strand-guiding rolls.

A number of proposed solutions for the configuration of the internal cooling of a strand-guiding roll are already known from the prior art.

According to one group of proposed solutions, an annular coolant passage or a plurality of flow passages in an annular arrangement are arranged between a roll shell and a central shaft or axle. One general drawback of this embodiment results from the considerable distance between the roll surface and the coolant passages, resulting in excessively high surface temperatures at the roll shell on account of the delayed heat transfer, with the result that additional external cooling is required.

A strand-guiding roll which belongs to this group of strand-guiding rolls is known, for example, from DE-A 25 52 969. This is a strand-guiding roll with a multiply mounted continuous shaft, on which individual roll shells are arranged fixed against rotation by a welded join. An annular space is formed as coolant passage between the central shaft and each roll shell, and this annular space is connected to central supply lines. This welded design does not allow the strand-guiding roll to be dismantled and therefore does not allow the roll shells, which are subject to high thermal and mechanical stresses, to be replaced. Since the coolant passage runs between the shaft and the roll shell, it is at a considerable distance from the roll shell surface, which has an adverse effect on the dissipation of heat from the roll shell. Rather, the roll shell as a whole in fact acts as a heat accumulator.

WO 02/38972 A1, with reference to FIGS. 1*a* and 1*b*, reports a prior art which relates to a strand-guiding roll with a central, multiply mounted shaft and a plurality of roll shells arranged thereon. The entire inner surface of each roll shell bears against the outer surface of the shaft and is joined to it fixed against rotation by a feather key. This strand-guiding roll is internally cooled by means of a coolant line which is routed centrally within the shaft. A strand-guiding roll of this type has the fundamental drawback of a particularly long heat transfer path from the shell surface to the coolant line. The assembly-related annular gap between the shaft and the roll shell acts as an insulator and additionally impedes the dissipation of heat from the strand-guiding roll.

Furthermore, WO 02/38972 A1 has disclosed a strand-guiding roll with a multiply mounted shaft and roll shell fitted onto it, each roll shell being arranged fixed against rotation on the shaft by means of a feather key. An annular space, which is filled with a material with a high thermal conductivity, is formed between the roll shell and the shaft over a subregion of the longitudinal extent of the roll shell. The heat is dissipated from the strand-guiding roll by internal cooling via a central coolant line which passes through the shaft. The thermally conductive filler material avoids the barrier action of an air gap between roll shell and shaft, but nevertheless there is still a considerable distance between the thermally stressed roll shell surface and the coolant line.

A strand-guiding roll with a single roll shell and coolant passages of various configurations between the roll shell and the roll core is also known from U.S. Pat. No. 4,442,883.

According to a further group of known proposed solutions, coolant passages are integrated directly in a substantially single-piece roll body, these coolant passages being formed by through-bores. It is in this way possible for the coolant passages to be arranged close to the roll surface and to achieve an increased cooling action by means of the resulting shorter heat transfer path.

Strand-guiding rolls of this type, with coolant bores distributed uniformly close to the roll surface, are already known from WO 93/19874, U.S. Pat. No. 5,279,535 and U.S. Pat. No. 4,506,727. These strand-guiding rolls are formed by a single-piece roll body with bearing journals adjoining it on both sides. The coolant is supplied via a rotary leadthrough, which adjoins the bearing journals at the end sides, and a central supply bore, from which radial branch lines lead to the coolant bores arranged at the roll periphery. A multiplicity of peripheral coolant bores are supplied with coolant from one branch line, with coolant flowing through the strand-guiding roll in alternating directions. The coolant is diverted in annular flanges attached to the end sides of the roll body by means of corresponding diversion passages which connect successive coolant bores to one another. However, single-piece strand-guiding rolls can only be used in continuous casting installations for producing relatively narrow slab strands with a width of up to 900 mm, and for strands with a bloom and billet cross section. In addition, in the event of damage to the roll surface, the single-piece roll requires complex repair work or requires the entire strand-guiding roll to be replaced.

A strand-guiding roll likewise with a single-piece structure of the roll body and therefore restricted possible uses is known from DE-C 33 15 376. Only the distribution of coolant to the peripherally arranged coolant bore takes place selectively, starting from a coolant chamber arranged in the roll body, by means of a control disk which opens up individual coolant bores.

SUMMARY OF THE INVENTION

Therefore, it is an object of the present invention to avoid the drawbacks of the known prior art and to propose a strand-guiding roll with internal cooling which quickly dissipates the heat quantities taken up by the roll shell and is better able to withstand the mechanical and thermal stresses caused by the strand. In particular, it is intended for it to be possible to increase the ease of maintenance of the strand-guiding roll and to carry out maintenance work more cost-effectively. A further object of the invention is to provide a strand-guiding roll which is suitable even for large cast widths and is structured in such a way that maintenance work can be restricted to replacing components that are susceptible to wear.

In a strand-guiding roll of the type according to the invention, this object is achieved by virtue of the fact that the roll shell has coolant passages passing through it, and the coolant passages are arranged in the roll shell at a constant distance from the cylindrical roll shell outer surface of the roll shell. According to a preferred embodiment, the coolant passages in the interior of the roll shell are oriented parallel to the axis of rotation of the strand-guiding roll. However, they may also be arranged helically, i.e. along a helical line around the axis of rotation of the strand-guiding roll, in terms of their longitudinal extent. The coolant passages are distributed uniformly in the interior of the roll shell, at the roll periphery near the roll shell outer surface, and are formed by through-bores, resulting in uniform roll shell cooling. The distance between the coolant passages and the roll shell outer surface is preferably between 10 and 40 mm. Therefore, the central shaft remains as far as possible unaffected by the thermal stressing of the roll shell. The supply of the coolant passages with coolant from central coolant lines in the central shaft is effected in any desired configuration.

To simplify production of the coolant passages in the roll shell, the roll shell may comprise two annular sleeves which are rotationally fixedly connected to one another, and the coolant passages, at the connecting lateral surfaces of the two annular sleeves, are machined into at least one of these connecting lateral surfaces. The two annular sleeves of the roll shell may be connected, for example, by a shrink-fit connection or by end-side welding.

According to another expedient embodiment, it is likewise possible for the coolant passages to be moved as close as possible to the roll shell outer surface, by virtue of the fact that the roll shell comprises at least one outer sleeve, which forms the roll shell outer surface, annular side parts and a displacement body, and this displacement body is inserted in a cavity in the roll shell extending between the annular side parts, the displacement body, together with the inner wall of the outer sleeve, forming coolant passages for a coolant to pass through. The displacement body, which is preferably made from a plastic, makes it simple to form coolant passages which are configured and routed in any desired way. The cross sections of the coolant passages may also adopt the shape of ring segments or may be reduced to a single annular coolant passage.

According to a preferred embodiment of the invention, at least one water guide ring is arranged between the roll shell and the central shaft. According to an expedient embodiment, the water guide ring is arranged in the end regions of the longitudinal extent of the roll shell, between the roll shell and the central shaft. Designing the water guide rings as independent components and arranging them in the edge regions of each roll shell results in functional separation between the components. The water guide ring is used exclusively to supply coolant to the coolant passages, and its internal diameter and external diameter are dimensioned in such a way that as far as possible no reaction forces from the strand and also no driving forces from the roll drives act on it and are transmitted via it. At the same time, suitable steps in the shaft diameter at the contact surfaces with the water guide rings result in simple assembly and dismantling of the strand-guiding roll for maintenance work and allow a roll shell to be replaced.

An advantageous configuration consists in the fact that the coolant passages in the roll shell are connected, via substantially radial branch lines, to a coolant line, which is arranged in the central shaft, for supplying and discharging a coolant, and the radial branch lines are routed through the water guide rings.

If water guide rings are arranged between the central shaft and the roll shell, the radial branch lines are arranged within the longitudinal extent of the water guide rings. It is expedient for the radial branch lines, within the longitudinal extent of the water guide rings, to open out into at least one distributor annular groove of the water guide ring. It is in this way possible for a multiplicity of peripheral coolant passages to be uniformly supplied with coolant from one coolant line arranged in the central shaft and at least one adjoining radial branch line for the supply and discharge of coolant.

In particular for manufacturing technology reasons, the branch lines in the roll shell are formed by substantially half-moon-shaped milled-out portions, in one side cheek of which in each case one of the peripheral coolant passages opens out.

A substantially optimum ratio of cooling action and manufacturing technology outlay involved in the production of the coolant passages is achieved if a plurality of, preferably three, coolant passages arranged parallel next to one another in the roll shell are connected to form one continuous coolant passage, and connecting passages between adjacent coolant passages are formed by end-side milled-in formations in the roll shell.

To transmit the forces acting on the roll shell to the central shaft, the roll shell is supported directly on the central shaft at least over a subregion of its longitudinal extent.

To avoid leaks at the coolant lines between the individual components of the strand-guiding roll, sealing elements, preferably sealing rings inserted into annular grooves, are arranged between the water guide rings and the roll shell and between the water guide rings and the central shaft.

A positively locking connection of the roll shell on the central shaft is achieved by at least one rotation preventer, preferably by one or more feather keys or other components with a similar action.

One possible configuration of the passage of coolant through the strand-guiding roll consists in the fact that the coolant line, which is routed in the central shaft, starts from one end side of the central shaft, and the coolant line for discharging coolant, which is arranged in the central shaft, opens out at the opposite end side of the central shaft, and each coolant line is assigned a rotary leadthrough.

An advantageous embodiment which allows the supply of coolant to the strand-guiding rolls to be restricted to one side of the installation or one side of the strand guidance of a continuous casting installation, consists in the fact that the coolant lines for supplying and discharging the coolant which are routed in the central shaft open out in one end side of the central shaft, and these coolant lines are assigned a multi-start rotary leadthrough. This embodiment can preferably be used for driven strand-guiding rolls, but can also be used for nondriven strand-guiding rolls.

The coolant used is usually cooling water.

BRIEF DESCRIPTION OF THE DRAWINGS

Further advantages and features of the present invention will emerge from the following description of non-restricting exemplary embodiments, in which reference is made to the accompanying figures, in which.

DESCRIPTION OF PREFERRED EMBODIMENTS

The illustrations in the figures show a strand-guiding roll according to the invention in diagrammatic form, this roll being suitable, for example, for use in a strand-guiding system of a continuous casting installation for producing metal strands of a considerable width with a slab or thin slab cross section. Identical or equivalent components in different embodiments are denoted by the same reference designations.

Figure 1:
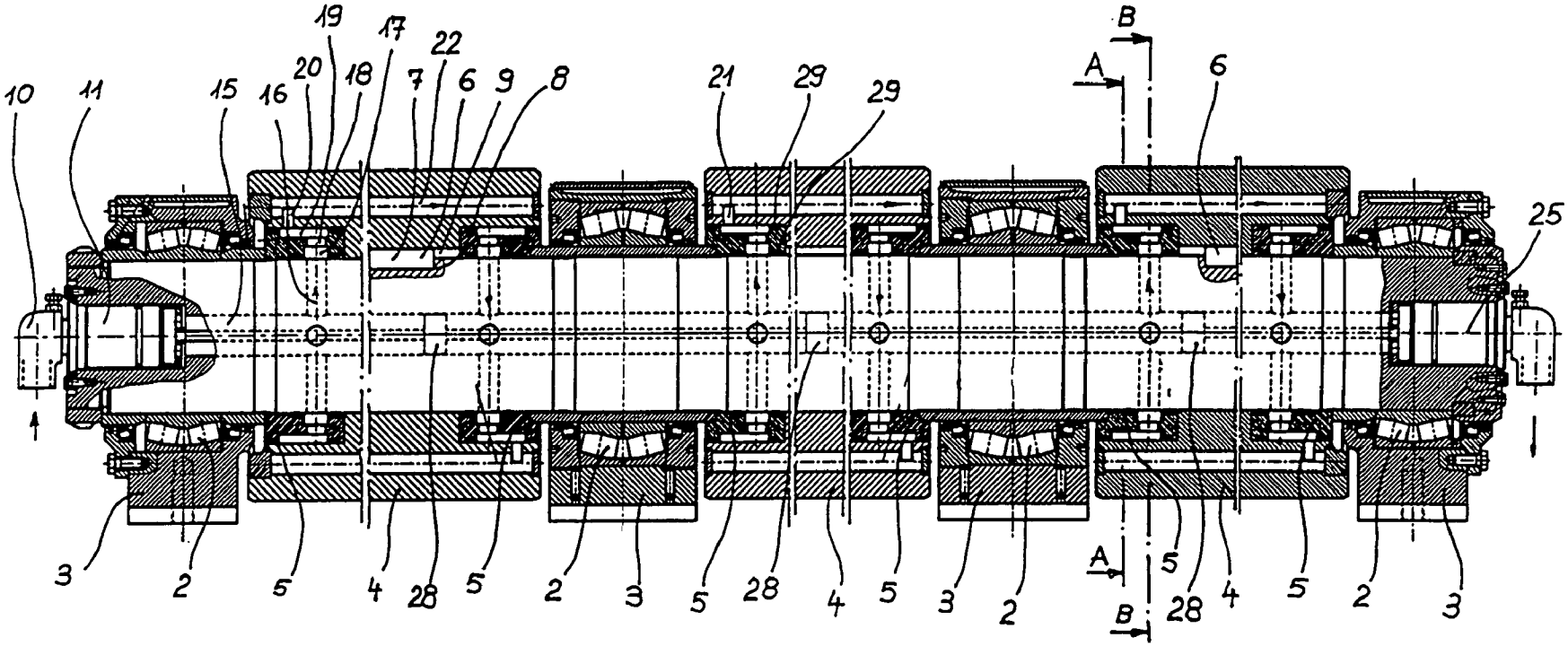
FIG. 1 diagrammatically depicts a longitudinal section through a strand-guiding roll according to the invention, FIG. 2 diagrammatically depicts a cross section through the strand-guiding roll on section line A-A in FIG. 1, FIG. 3 diagrammatically depicts a cross section through the strand-guiding roll on section line B-B in FIG. 1, FIG. 4 diagrammatically depicts a longitudinal section through another embodiment of a strand-guiding roll according to the invention, FIG. 5 diagrammatically depicts a two-part roll shell with a helical coolant passage, FIG. 6 diagrammatically depicts a longitudinal section through another embodiment of a strand-guiding roll according to the invention.

The strand-guiding roll illustrated in FIG. 1 comprises a continuous, central shaft 1, which is supported rotatably in four bearings 2. The bearings and the bearing housings 3 which carry them are for their part supported in a strand-guiding stand (not shown) of a continuous casting installation. The bearings used are usually rolling-contact bearings. The central shaft 1 is assigned three roll shells 4, each of the three roll shells being supported directly on the shaft 1. During the production phase of the continuous casting installation, the roll shell outer surface 4*a* of the roll shell is in linear contact with the cast strand and takes up heat from it. In addition, each roll shell is assigned two water guide rings 5, these water guide rings 5 being positioned between the central shaft 1 and the roll shell 4, in the end regions of its longitudinal extent.

The bearings 2 and the bearing housings 3 surrounding them are located outside the longitudinal extent of the adjacent roll shells 4. The position of each roll shell 4 is fixed against rotation with respect to the shaft 1 by a rotation preventer 6. This rotation preventer 6 is formed by a feather key 7 which engages, centrally with respect to the longitudinal extent of the respective roll shell 4, in associated longitudinal grooves 8, 9 in the central shaft 1 and the respective roll shell 4, forms a positively locking connection and transmits torques acting on the rolls.

The strand-guiding roll is equipped with internal cooling. The path of the coolant flow is indicated by arrows in FIG. 1. The coolant is supplied at one end side of the central shaft 1 via a rotary leadthrough 10, which is fitted into an end-side recess 11 in the central shaft 1. The coolant is discharged at the opposite end side of the central shaft 1 through a further rotary leadthrough 12, which is likewise fitted into an end-side recess 13 in the central shaft. Via a central coolant line 15, which passes through the central shaft 1 in the axial direction, via radial branch lines 16, which branch off from the central coolant line 15 and open out in a first distributor annular groove 17 at the water guide ring 5, via further radial branch lines 18, which connect the first distributor annular groove 17 to a second distributor annular groove 19 at the water guide ring 5, and via further radial branch lines 20 in the roll shell 4, which are formed by half-moon-shaped milled-out portions 21, coolant is introduced into coolant passages 22, which open out into cheeks of these milled-out portions 21, run parallel to the axis of rotation 25 of the strand-guiding roll and are distributed uniformly in the interior of the roll shell 4 at a short distance from the roll shell surface.

Figure 2:
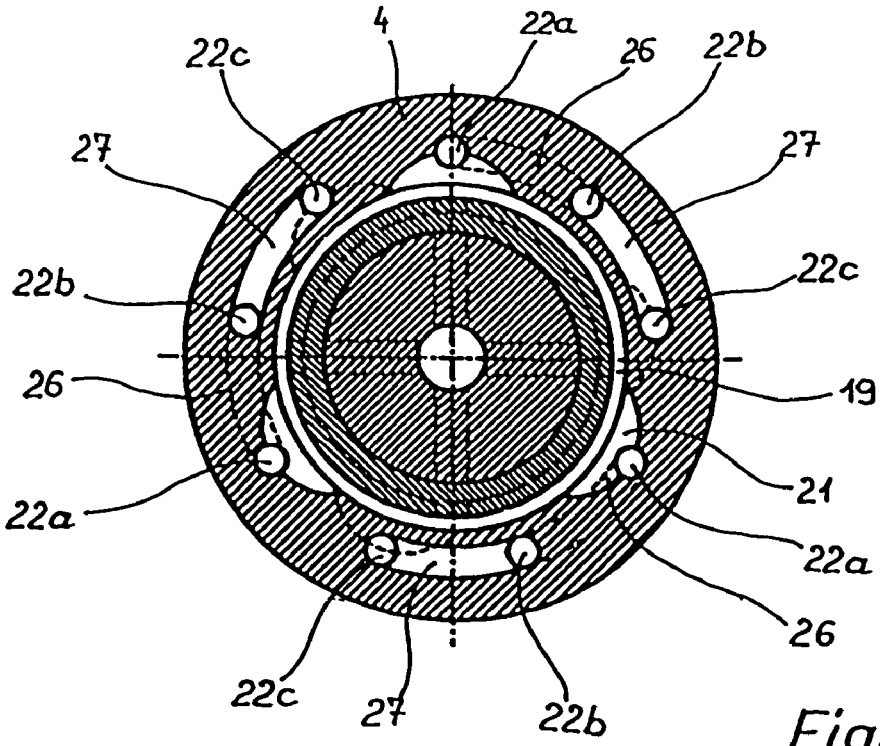

The coolant flows in series through three coolant passages 22*a*, 22*b*, 22*c* arranged in the periphery of the roll shell 4, next to one another in the circumferential direction, as illustrated in FIG. 2 which represents a sectional illustration on line A-A from FIG. 1, this section being taken through the second distributor annular groove 19 and the inlet-side half-moon-shaped milled-out portion 21. These coolant passages 22*a*, 22*b*, 22*c* are connected by connecting passages 26, 27, which are formed by covered milled-in formations in the end sides of the roll shell 4. A uniform cooling action over the longitudinal extent of the roll shell is achieved by reversing the direction of flow in adjacent coolant passages 22*a*, 22*b* and 22*b*, 22*c*. The combination of three adjacent coolant passages 22*a*, 22*b*, 22*c* has in this case proven to be the most effective embodiment, since the uptake of heat by the coolant in one roll shell is kept within a range which ensures approximately the same order of magnitude of uptake of heat in the roll shells through which the coolant subsequently flows.

In the embodiment illustrated in FIG. 1, the coolant passages 22 are formed by through-bores which are routed close to the roll shell outer surface 4*a*, parallel to the axis of rotation 25 of the strand-guiding roll. The distance between the coolant passages 22 and the roll shell outer surface 4*a* is approximately 10 to 40 mm, thereby allowing intensive cooling and dissipation of heat, so that in steady-state casting operation low surface temperatures of from 130° to 180° can be maintained.

Figure 3:
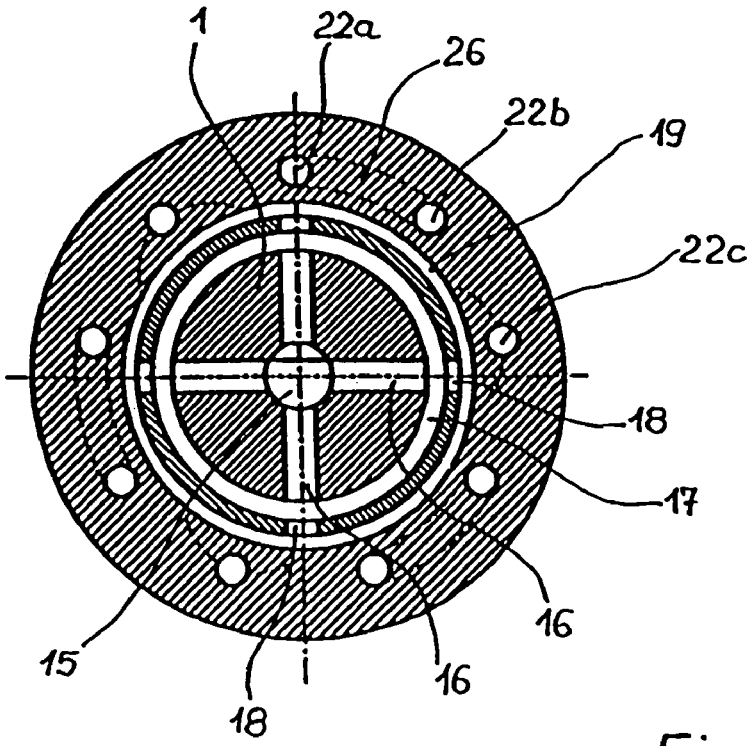

FIG. 3 shows another sectional illustration of the strand-guiding roll on section line B-B from FIG. 1, this section being taken through the radial branch bores 16, 18. This illustration shows the central coolant line 15 in the central shaft 1, the four branch lines 16, which lead radially away from the central coolant line and open out in a first distributor annular groove 17, and four radial branch lines 18 which lead further onward and produce the connection to the second distributor annular groove 19. The coolant passages 22*a*, 22*b*, 22*c*, which are combined via connecting passages, of which only the connecting passage 26 is illustrated, open out into the half-moon-shaped milled-out portion 21, which adjoins the coolant passage 22*c* on the outlet side and is indicated by thin lines in this figure.

The coolant is returned from the peripheral coolant passages 22 in the reverse order to the way in which it was supplied. The connected coolant passages 22*a*, 22*b*, 22*c* open out into branch lines 20, which are formed by half-moon-shaped milled-out portion 21 in the roll shell 4 and produce a connection to the second distributor annular groove 19 in the water guide ring 5. Branch lines 18 connect the second distributor annular groove 19 to a first distributor annular groove 17 in the water guide ring 5, from where further radial branch lines 16 return the coolant into the central coolant line 15, through which the coolant leaves the strand-guiding roll again via the rotary leadthrough 12.

A number of blocking elements 28 corresponding to the number of roll shells 4 are inserted into the central coolant line 15 and are used to interrupt the continuous central coolant line in such a way that the coolant passes through the individual roll shells of a strand-guiding roll in one pass.

However, it is also possible for the coolant to be supplied and discharged through the central coolant lines at just one end side of the central shaft, via a two-start rotary leadthrough, with the result that the coolant supply is restricted to one side of the strand-guiding arrangement and therefore one side of a continuous casting installation.

The supply of coolant to and discharge of coolant from the strand-guiding roll may also take place via the strand-guiding stand and the bearing blocks of the bearings which support the strand-guiding roll.

To ensure that it is impossible for any coolant to escape at the contact surfaces between central shaft 1 and the water guide rings 5 and/or at the contact surfaces between roll shell 4 and the water guide rings 5, sealing elements 19 are arranged in these regions. These sealing elements are formed by sealing rings fitted into annular grooves.

Figure 4:
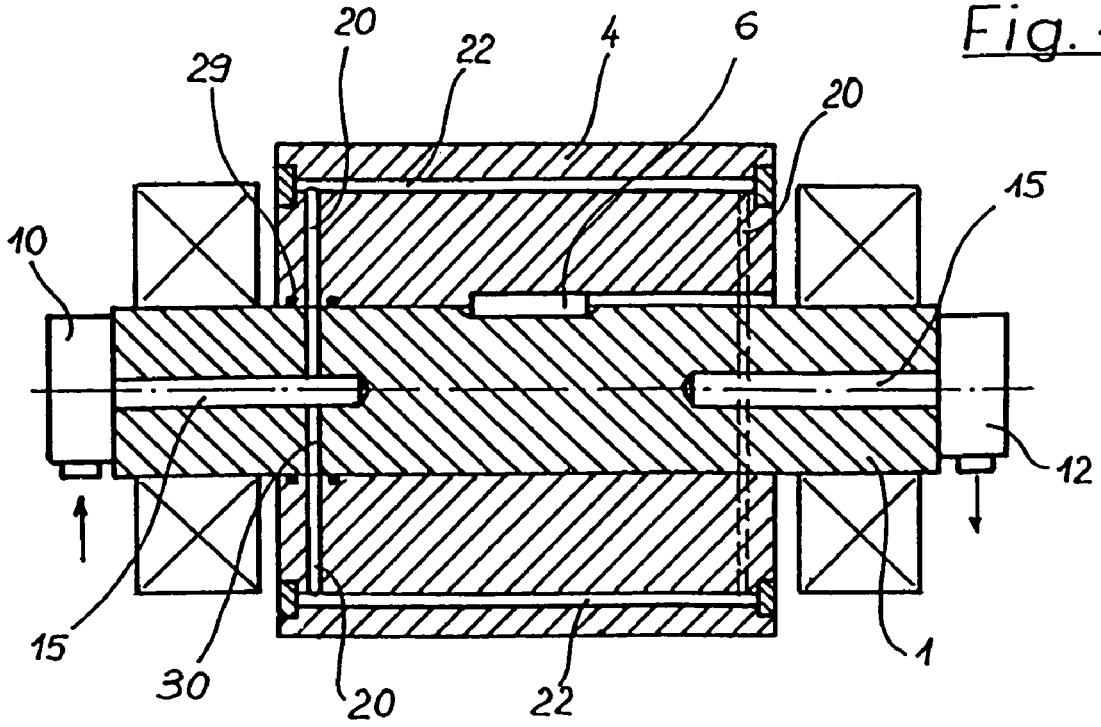

FIG. 4 diagrammatically depicts a strand-guiding roll of the type according to the invention without the incorporation of a water guide ring. A roll shell 4 is supported directly on the central shaft 1 and is protected against rotation by a rotation preventer 6, which is formed by a feather key, thereby allowing torque to be transmitted from the shaft to the roll shell and vice versa. As in the embodiment shown in FIG. 1, it is possible for a plurality of roll shells to be provided, with the interconnection of a bearing position for the continuous central shaft.

The coolant is passed through the strand-guiding roll starting from a rotary leadthrough 10 then through the central coolant line 15 and branch lines 30 to the axial coolant passages 22 and from the latter back through branch lines 30 and the central coolant line 15 to a further rotary leadthrough 12. Sealing elements 29 are fitted, for example, into the inner shell surface of the roll shell 4, laterally with respect to the branch lines 30, in annular grooves, preventing leakage losses. The coolant passages 22 are formed by through-bores in the roll shell 4.

Figure 5:
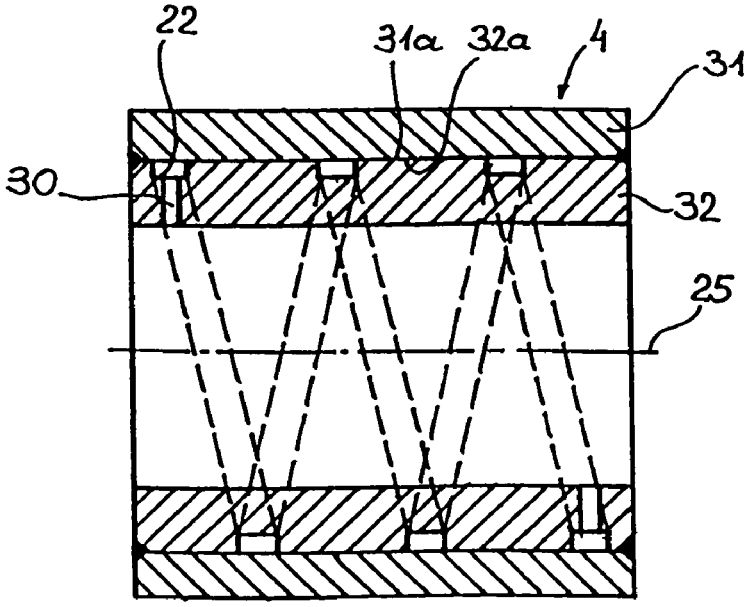

As is diagrammatically depicted in FIG. 5, it is also possible for a coolant passage 22 which runs helically along a helical line about the axis of rotation 25 of the strand-guiding roll to pass through the roll shell 4. The roll shell 4 is formed by two annular sleeves 31, 32 which are connected to one another in a manner fixed against rotation, in which case, at the connecting lateral surfaces 31*a*, 32*a* of these sleeves 31, 32, a helical coolant passage 22 is machined into one of these lateral surfaces, here 32*a*. The connection of the two sleeves 31, 32 in a manner fixed against rotation is produced by welding. However, it may also be effected by shrink-fitting. Equally, it is also possible for the roll shell to be formed by two sleeves that are connected in a manner fixed against rotation in the arrangement of straight coolant passages arranged parallel to the axis of rotation of the strand-guiding roll. In this case, the coolant passages can be produced in the inner lateral surface or outer lateral surface of the connecting lateral surfaces by longitudinal impacting, in a manner which is simple in terms of manufacturing technology.

Figure 6:
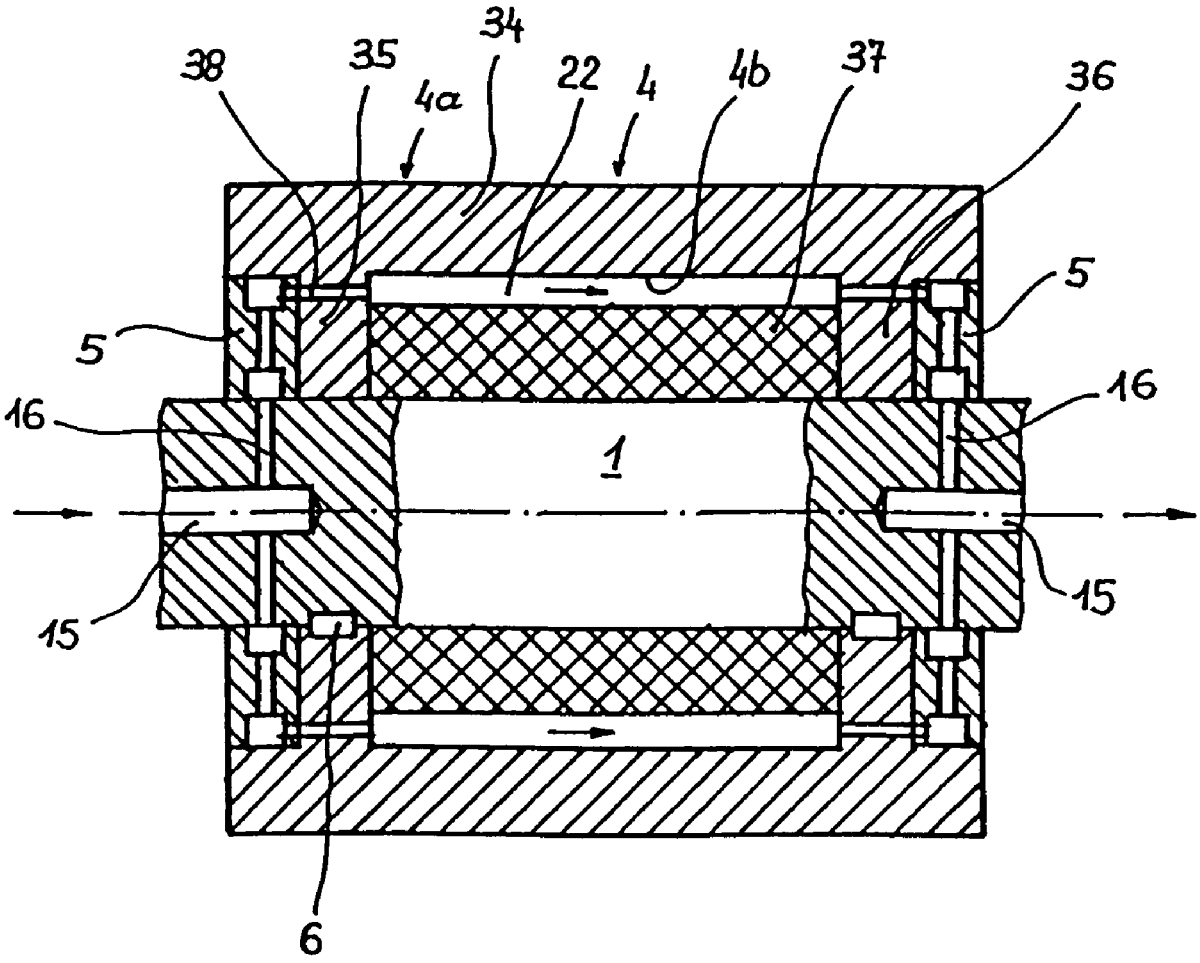

Another embodiment of the strand-guiding roll according to the invention is illustrated in FIG. 6. A roll shell 4, which is formed by an outer sleeve 34, annular side parts 35, 36 and a displacement body 37, is supported on the central rotatable shaft 1. The roll shell is fixed to the central shaft 1 using rotation preventers 6. Water guide rings 5 are arranged between the roll shell 4 and the central shaft 1 in the end regions of the longitudinal extent of the roll shell, and allow the coolant to be transferred from a coolant line 15 arranged in the central shaft via branch lines 16 and connecting lines 38 to at least one coolant passage 22, preferably coolant passages 22 distributed uniformly on a pitch circle. The coolant is discharged in a similar way as in the embodiments which have already been described. The coolant passages 22 arranged parallel to the axis of rotation 25 of the strand-guiding roll are formed by the inner wall 4*b* of the roll shell 4 and recesses at the outer circumference of the displacement body 37. The direction of flow of the coolant, the cross-sectional shape of the coolant passages and their straight or helical orientation can be configured entirely as desired in this context.

The invention is not restricted to the present exemplary embodiment. Rather, this strand-guiding roll can be modified in numerous ways within the scope of protection.

By way of example, the strand-guiding roll may, depending on the installation-specific casting widths on a continuous casting installation, comprise a certain number of roll shells; from one to four roll shells arranged on one continuous central shaft are customary for supporting and guiding cast strands. It is also possible for in each case two water guide rings arranged between a roll shell and the central shaft to be combined in one water guide ring of sleeve-like design, in which case the sleeve-like water guide ring has the rotation preventer passing through it. Furthermore, the roll shell outer surface may additionally be protected from the high levels of wear by welded-on applications. However, it is also possible within the scope of protection for an additional wear-resistant sleeve to be applied to the roll shell, for example by shrink-fitting or end-side welding, with this sleeve being removed or replaced as it becomes worn.

The invention claimed is:

1. An internally cooled strand-guiding roll for a continuous casting installation, comprising:

a central rotatable shaft;

a coolant line passing through the central rotatable shaft supplying and discharging a coolant;

at least one roll shell positioned around the central rotatable shaft, the roll shell being fixedly secured against rotation of the central rotatable shaft and, having a cylindrical outer surface and an inner surface;

coolant passages passing through the roll shell, the coolant passages being arranged in the roll shell at a constant distance from the cylindrical outer surface of the roll shell;

at least one water guide ring arranged between the inner surface of the roll shell and the central rotatable shaft and being operable to distribute the coolant to the coolant passages; and substantially radial branch coolant lines extending from the coolant line of the central rotatable shaft to the coolant passages of the roll shell, the radial branch coolant lines being routed through the water guide ring.

2. The strand-guiding roll as claimed in claim 1, wherein the coolant passages in the roll shell are oriented parallel to an axis of rotation of the strand-guiding roll.

3. The strand-guiding roll as claimed in claim 1, wherein the coolant passages in the roll shell extend helically around the axis of rotation of the strand-guiding roll.

4. The strand-guiding roll as claimed in claim 1, wherein the roll shell comprises two annular sleeves, the sleeves having connecting lateral surfaces overlaying each other, wherein the annular sleeves are fixedly connected to one another against rotation of the central rotatable shaft, and wherein the coolant passages are located at a region of the connecting lateral surfaces of the two annular sleeves; and are formed in at least one of the connecting lateral surfaces.

5. The strand-guiding roll as claimed in claim 1, wherein the roll shell comprises at least one outer sleeve, which forms the cylindrical outer surface, the outer sleeve having an inner wall and laterally spaced apart annular side parts extending between the inner wall of the outer sleeve and the central rotatable shaft and defining a cavity between the annular side parts, the inner wall of the outer sleeve and the central rotatable shaft; and wherein the roll shell further comprises a displacement body positioned in the cavity extending between the annular side parts, the displacement body together with the inner wall of the outer sleeve forming the coolant passages at the cavity for the coolant to pass through.

6. The strand-guiding roll as claimed in claim 1, wherein the distance between the coolant passages and the outer surface of the roll shell is between 10 mm and 40 mm.

7. The strand-guiding roll as claimed in claim 1, wherein the water guide ring is arranged at one of end regions of a longitudinal extent of the roll shell.

8. The strand-guiding roll as claimed in claim 7, further comprising sealing elements, inserted into annular grooves, and arranged between the water guide rings and the roll shell and between the water guide rings and the central shaft.

9. The strand-guiding roll as claimed in claim 1, wherein within a longitudinal extent of the water guide ring, the radial branch coolant lines open out into at least one distributor annular groove of the water guide ring.

10. The strand-guiding roll as claimed in claim 1, wherein portions of the radial branch coolant lines located in the roll shell comprise substantially half-moon cross-sectional shape.

11. The strand-guiding roll as claimed in claim 1, wherein the coolant passages are arranged parallel and generally next to one another in the roll shell, and wherein adjacent ones of the coolant passages are connected by connecting passages to form one continuous coolant passages, the connecting passages comprising milled-in formations in end sides of the roll shell.

12. The strand-guiding roll as claimed in claim 1, wherein the roll shell is supported directly on the central shaft at least over a subregion of a longitudinal extent of the roll shell.

13. The strand-guiding roll as claimed in claim 1, further comprising a rotation preventer fixing the roll shell against rotation with respect to the shaft.

14. The strand-guiding roll as claimed in claim 13, wherein the rotation preventer comprises a feather key between the roll shell and the shaft.

15. The strand-guiding roll as claimed in claim 1, further comprising a supply coolant line for supplying the coolant into the coolant line of the central shaft, starting from one end side of the central shaft, and a discharge line for discharging the coolant, the discharge line being arranged in the central shaft and opening out at an opposite end side of the central shaft; the coolant line being assigned a respective rotary leadthrough.

16. The strand-guiding roll as claimed in claim 1, comprising a plurality of the coolant lines routed in the central shaft and open out at one end side of the central shaft, each of the coolant lines being assigned a respective multi-start rotary leadthrough.

* * * * *